US006741149B2

(12) United States Patent
Kuroda et al.

(10) Patent No.: US 6,741,149 B2
(45) Date of Patent: May 25, 2004

(54) DIELECTRIC FILTER, DIELECTRIC DUPLEXER, AND COMMUNICATION APPARATUS

(75) Inventors: Katsuhito Kuroda, Matsutou (JP); Jinsei Ishihara, Kanazawa (JP); Hideyuki Kato, Ishikawa-ken (JP)

(73) Assignee: Murata Manufacturing Co., Ltd (JP)

( * ) Notice: Subject to any disclaimer, the term of this patent is extended or adjusted under 35 U.S.C. 154(b) by 73 days.

(21) Appl. No.: 10/178,004

(22) Filed: Jun. 20, 2002

(65) Prior Publication Data

US 2002/0196106 A1 Dec. 26, 2002

(30) Foreign Application Priority Data

Jun. 20, 2001 (JP) ..... 2001-186525

(51) Int. Cl.[7] ..... H01P 1/20
(52) U.S. Cl. ..... 333/206; 333/202
(58) Field of Search ..... 333/202, 206, 333/222, 207, 223; 330/134

(56) References Cited

U.S. PATENT DOCUMENTS

| | | | | |
|---|---|---|---|---|
| 5,696,473 A | * | 12/1997 | Tsujiguchi et al. | 333/202 |
| 5,945,896 A | * | 8/1999 | Miyamoto | 333/206 |
| 6,294,969 B1 | * | 9/2001 | Matsuo et al. | 333/206 |
| 6,496,088 B1 | * | 12/2002 | Okada et al. | 333/202 |
| 6,556,106 B1 | * | 4/2003 | Sano et al. | 333/202 |

FOREIGN PATENT DOCUMENTS

| | | |
|---|---|---|
| JP | 63-90203 | 4/1988 |
| JP | 07-254806 | 10/1995 |

* cited by examiner

*Primary Examiner*—Minh Nguyen
(74) *Attorney, Agent, or Firm*—Dickstein, Shapiro, Morin & Oshinsky, LLP.

(57) ABSTRACT

A dielectric block includes a plurality of plated through holes each having an inner conductor formed thereon to form respective plated through holes. At least one of the plated through holes branches into two legs at the short circuit side thereof so that the two legs are close to the short circuit side of the plated through holes adjacent thereto. This allows the resonators formed of the plated through holes to be strongly inductively coupled with each other.

5 Claims, 9 Drawing Sheets

DIELECTRIC FILTER, DIELECTRIC DUPLEXER, AND COMMUNICATION APPARATUS

BACKGROUND OF THE INVENTION

1. Field of the Invention

The present invention relates to a dielectric filter, a dielectric duplexer, and a communication apparatus using the same for use, preferably in the microwave band.

2. Description of the Related Art

A known dielectric filter comprises a plurality of dielectric resonators found in a single dielectric block. Each resonator is defined by a through hole extending through the dielectric block and has an inner electrode formed thereon forming a plated through hole. Each plated through hole has an open circuit end and a closed circuit end. Adjacent resonators are capacitively or inductively coupled to one another. Such filters are typically used in microwave-band communication apparatus, etc. In this type of dielectric filter, an attenuation pole is produced at a low-frequency region of the pass band when adjacent resonators are capacitively coupled with each other, and an attenuation pole is produced at a high-frequency region of the pass band when adjacent resonators are inductively coupled with each other.

One such prior art resonator is disclosed in Japanese Unexamined Patent Application Publication No. 7-254806. In this resonator each plated through hole has a stepped portion in the middle thereof to make the axial spacing between adjacent plated through holes at the short circuit side of the plated through different from that at the open side circuit thereof to provide inductive or capacitive coupling therebetween.

FIGS. 12A, 12B and FIG. 13 show this type of dielectric filter. A substantially rectangular dielectric block 1 has three plated through holes 2*a*, 2*b*, and 2*c* formed therein. An outer conductor 3 is formed on the exterior surface of the dielectric block 1 and is directly coupled to the inner conductor of the through holes on the short circuit side thereof. In FIGS. 12A and 12B, the axial spacing between the plated through holes 2*a* and 2*b* at the open circuit side is wider than at the short circuit side to create an inductive coupling at area Sab which is stronger than capacitive coupling at area Oab, resulting in inductive coupling between resonators defined by the plated through holes 2*a* and 2*b*. Likewise, the axial spacing between the plated through holes 2*b* and 2*c* at the open circuit side is wider than at the short circuit side to make the inductive coupling at area Sbc stronger than capacitive coupling at an area Obc, resulting in inductive coupling between resonators formed of the plated through holes 2*b* and 2*c*.

In FIG. 13, the axial spacing between the plated through holes 2*a* and 2*b* at the short circuit side is narrower than at the open circuit side to increase inductive coupling at area Sab compared to the capacitive coupling at area Oab, so that resonators defined by the plated through holes 2*a* and 2*b* are strongly inductively coupled with each other. On the other hand, the axial spacing between the plated through holes 2*b* and 2*c* at the open circuit side is narrower than at the short circuit side to increase capacitive coupling at area Obc compared to inductive coupling at area Sbc, so that resonators formed of the plated through holes 2*b* and 2*c* may be capacitively coupled with each other.

In a dielectric filter having three resonators, as shown in FIGS. 12A, 12B, and 13, however, if the second resonator is closer to the first resonator at the short circuit side (so that the first and second resonators are strongly inductively coupled with each other) then the second resonator is farther from a third resonator at the short circuit side, thereby providing weak inductive coupling between the second and third resonators. If the inner diameter of plated through holes increases at the short circuit side in order to enhance the mutual capacitance at the short circuit side between the first and second resonators and between the second and third resonators, the self-impedance of the resonators decreases to reduce the mutual capacitance, thereby canceling out the effect of increasing the inductive coupling. This also decreases the ratio (step ratio) of the inner diameter at the short circuit side to the open side of a plated through hole, thus lowering the wavelength constant, while requiring longer plated through holes, resulting in a more bulky device.

For these reasons, the first and second resonators are inductively coupled with each other, and the second and third resonators are also inductively coupled with each other, which limits the amount of coupling.

SUMMARY OF THE INVENTION

Accordingly, it is an object of the present invention to provide a dielectric filter, a dielectric duplexer, and a communication apparatus using the same, which are capable of providing strong inductive coupling among three adjacent dielectric resonators in a dielectric block.

To this end, in one aspect of the present invention, a dielectric filter includes:

A dielectric filter comprising:

a dielectric block having first and second opposed surfaces;

an outer conductor formed on exterior surfaces of said dielectric block;

is a plurality of plated through holes extending from the first to the second surface of the dielectric block;

a respective inner conductor formed on each of the plated through holes, each conductor having a short circuit end directly coupled to the outer conductor and an open circuit end capacitively coupled to the outer conductor; and at least one of the plated through holes branching into a plurality of legs each having a short circuit end directly coupled to the outer conductor.

With this structure, for example, the axial spacing between the central plated through hole and plated through holes adjacent thereto may be narrowed at the short circuit side. This makes it possible to strongly inductively couple the first and second resonators on the one hand and the second and third resonators on the other, thereby readily achieving a bandpass characteristic of a broad band.

The location at which the plated through hole branches into a plurality of legs is preferably positioned substantially at the center of the plated through holes in the longitudinal direction thereof. This makes it possible to place the inner conductors on adjacent plated through holes close to each other at a high-magnetic-field-strength region, resulting in the maximum amount of coupling between adjacent resonators to achieve a high versatility in design. Furthermore, each plated through hole has a larger cross-section at the open circuit side than at the short circuit side, that is, each has a stepped structure, thereby improving the effect of reducing the axial length of plated through holes.

In another aspect of the present invention, a dielectric duplexer includes a transmission filter and a reception filter, each filter comprising the above-described dielectric filter. The dielectric duplexer allows adjacent resonators to be strongly inductively coupled with each other in a sequential manner, thus achieving a predetermined filter characteristic with a compact chassis.

In another aspect of the present invention, a communication apparatus includes the above-described dielectric filter. Therefore, a compact communication apparatus having a superior communication performance is achieved.

DESCRIPTION OF THE PREFERRED EMBODIMENTS

Figure 1A:
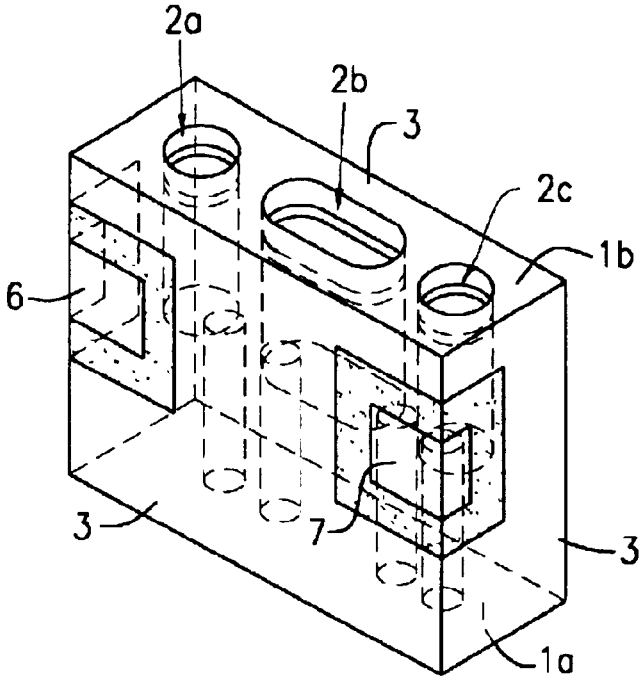
FIGS. 1A and 1B are a perspective view and a cross-sectional view of a dielectric filter according to a first embodiment of the present invention, respectively.
Figure 1B:
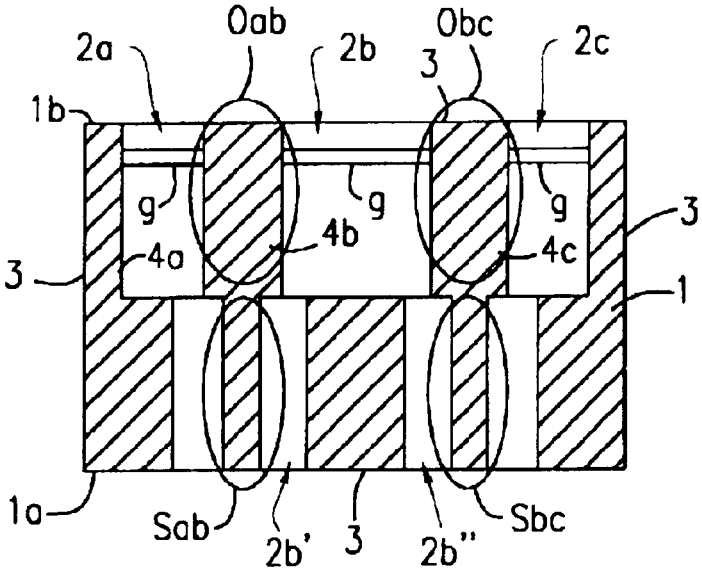

FIGS. 1A and 1B show a dielectric filter according to a first preferred embodiment of the invention. A substantially rectangular dielectric block 1 includes three plated through holes 2*a*, 2*b*, and 2*c* each extending from a first surface la to a second surface 1*b* of the dielectric block 1. Each of the plated through holes 2*a*, 2*b*, and 2*c* are defined by a respective through hole and an inner conductor 4*a*, 4*b* or 4*c* formed on the inner surface of the through holes. An outer conductor 3 is formed on the exterior (six) surfaces of the dielectric block 1. First ends of the inner conductors 4*a*, 4*b*, and 4*c* are connected (short circuited) to the outer conductor 3 at the bottom surface 1*a*. Each of the plated through holes 2*a* to 2*c* is provided with an conductor-free area g in the vicinity of top surface 1*b* of the dielectric block 1 to create an open circuit end of the plated through holes. Input/output electrodes 6 and 7 are formed on the exterior surface of the dielectric block 1 so as to be isolated from the outer conductor 3, so that capacitances are produced substantially between the open circuit ends of the inner conductors 4*a* and 4*c* and the input/output electrodes 6 and 7, respectively.

The plated through hole 2*b* is elliptical in cross-section at the open circuit side adjacent top surface 1*b* so that the elliptic shape of the plated through hole 2*b* extends toward the plated through holes 2*a* and 2*c* adjacent thereto. The plated through hole 2*b* branches into two legs 2*b*' and 2*b*" at the short circuit side adjacent to the bottom surface 1*a*. The legs 2*b*' and 2*b*" are positioned close to the short circuit side of the plated through holes 2*a* and 2*c*, respectively.

The plated through holes 2*a* and 2*c* have a greater inner diameter at the open circuit side than at the short circuit side. The short circuit side of the plated through holes 2*a* and 2*c* is positioned close to the short circuit side of the legs 2*b*' and 2*b*" of the plated through hole 2*b*.

Accordingly, the spacing between the legs 2*b*' and 2*b*" of the plated through hole 2*b* and the plated through holes 2*a* and 2*c* is relatively narrower at the short circuit side than at the open circuit side, thereby making inductive coupling at areas Sab and Sbc stronger than capacitive coupling at areas Oab and Obc. This provides strong inductive coupling between the first and second resonators on the one hand and between the second and third resonators on the other.

The position at which the plated through hole 2*b* branches into the two legs 2*b*' and 2*b*" is arbitrary. However, it is preferably, substantially at the center in the longitudinal direction of the plated through hole 2*b*.

This structure allows inner conductors formed on the adjacent plated through holes to be close to each other at a high-magnetic-field-strength region, resulting in the maximum amount of coupling between adjacent resonators formed of the plated through holes. This also makes it possible to achieve a higher versatility in design. Furthermore, each plated through hole has a larger cross-section at the open circuit side than at the short circuit side, that is, has a stepped structure, thereby improving the effect of reducing the axial length of plated through holes.

Figure 2A:
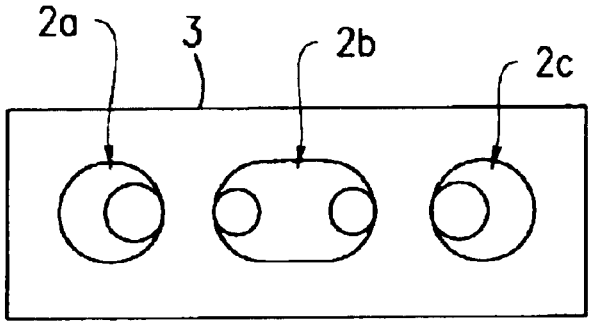
FIGS. 2A and 2B are a top plan view and a cross-sectional view of a dielectric filter according to a second embodiment of the present invention, respectively.
Figure 2B:
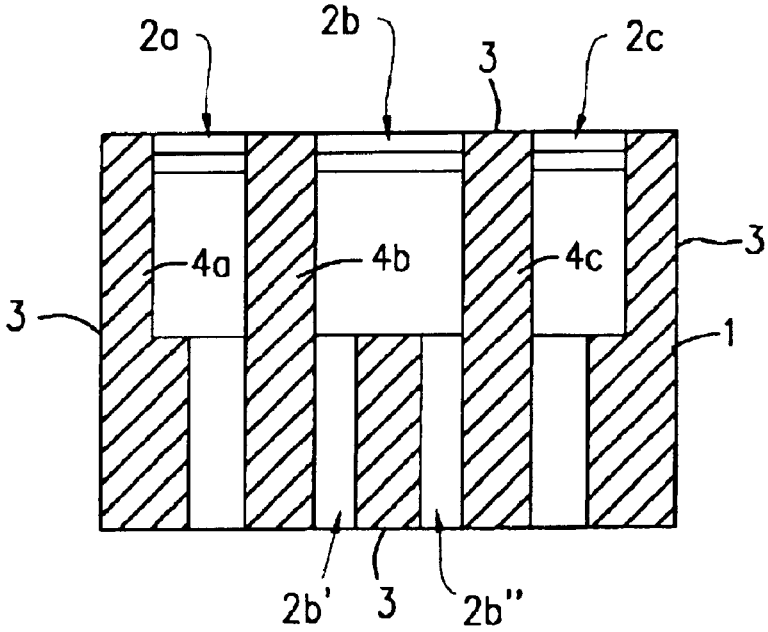

A second embodiment of the invention is shown in FIGS. 2*a* and 2*b*. The difference between the first and second embodiments is the shape of plated through holes. Like the first embodiment, the plated through hole 2*b* of the second embodiment branches into two legs 2*b*' and 2*b*" at the short circuit side. Additionally, the axial spacing between adjacent plated through holes is narrower at the short circuit side than at the open circuit side. In the dielectric filter according to the second embodiment, however, the plated through holes 2*a* and 2*c* are not shifted outward at the short circuit side with respect to the open circuit side. Likewise, the legs 2*b*' and 2*b*" of the plated through hole 2*b* at the short circuit side are not shifted outward at the open circuit side.

This structure also relatively increases the inductive coupling between the first and second resonators on the one hand, and between the second and third resonators on the other, compared to capacitive coupling therebetween, so that the first and second resonators can be strongly inductively coupled with the second and third resonators, respectively.

Figure 3A:
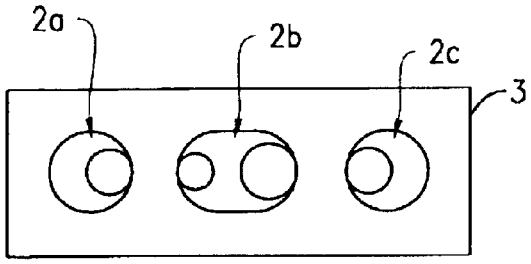
FIGS. 3A and 3B are a top plan view and a cross-sectional view of a dielectric filter according to a third embodiment of the present invention, respectively.
Figure 3B:
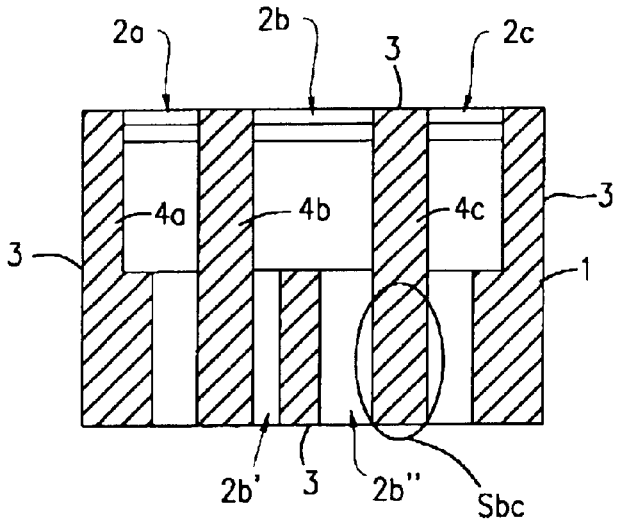

A third embodiment of the present invention as shown in FIGS. 3A and 3B. The difference between the second and third embodiments is the shape of plated through holes. The legs 2*b*' and 2*b*" of the plated through hole 2*b* of the second embodiment have the same inner diameter. However, in the third embodiment the leg 2*b*" has a larger inner diameter than the hole 2*b*'. This structure provides stronger inductive coupling at an area Sbc compared to the dielectric filter of the second embodiment resulting in a stronger inductive coupling between the second resonator and the third resonator.

Figure 4:
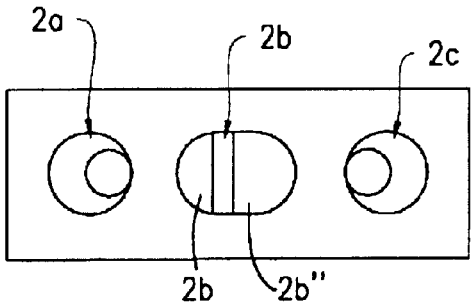
FIG. 4 is a top plan view of a dielectric filter according to a fourth embodiment of the present invention.

FIG. 4 is a top plan view of a dielectric filter according to a fourth embodiment of the present invention. While the branched legs 2*b*' and 2*b*" of the plated through hole 2*b* is circular in cross-section in the first to third embodiment, the holes 2*b*' and 2*b*" are semicircular in cross-section according to the fourth embodiment shown in FIG. 4. Alternatively, the legs 2*b*' and 2*b*" may have other cross-sections such as rectangular, polygonal cross-sections.

Figure 5A:
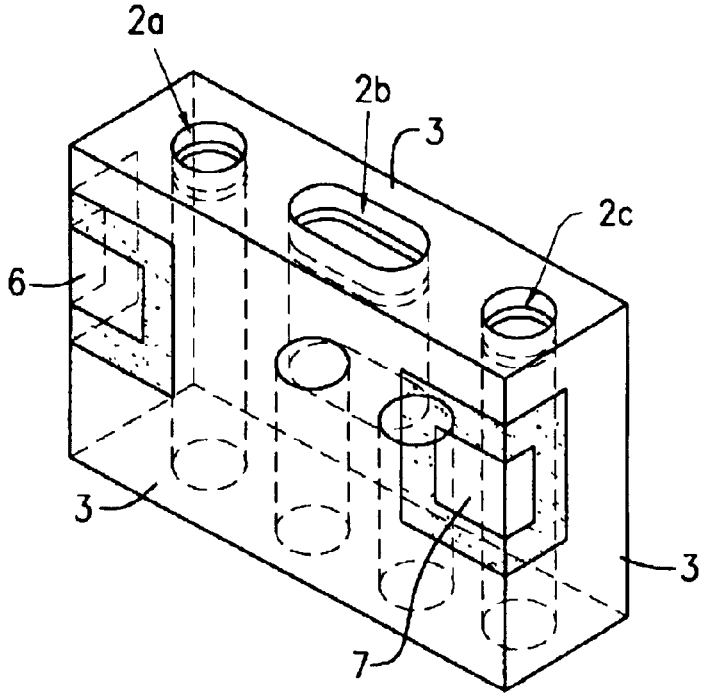
FIGS. 5A and 5B are a perspective view and a cross-sectional view of a dielectric filter according to a fifth embodiment of the present invention, respectively.
Figure 5B:
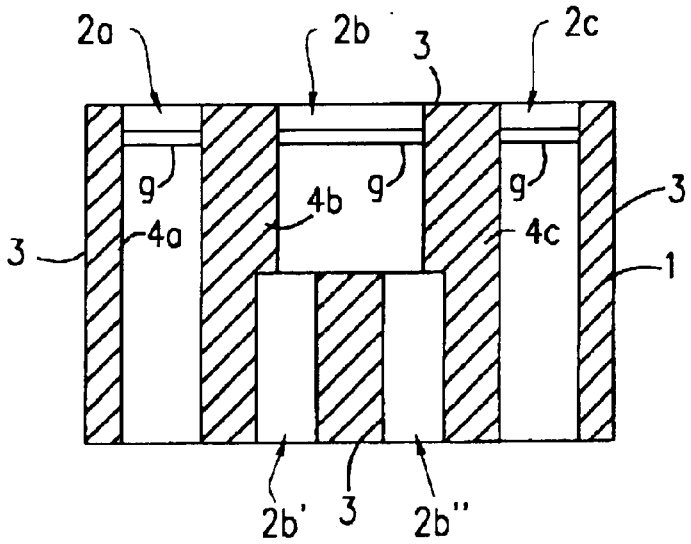

A fifth embodiment of the present invention is shown in FIGS. 5A and 5B. The plated through hole 2*b* of this embodiment is similar to that of the first embodiment. Particularly, the plated through hole 2*b* is elliptical in cross-section at the open circuit side so that the elliptic shape of the plated through hole extends toward the plated through holes 2*a* and 2*c*. Furthermore, the plated through hole 2*b* branches into two legs 2*b*' and 2*b*" at the short circuit side, and the legs 2*b*' and 2*b*" are positioned close to the short circuit side of the plated through legs 2*a* and 2*c*, respectively.

In the first embodiment, the plated through holes 2*a* and 2*c* has a larger inner diameter at the open circuit side than at the short circuit side, and are positioned closer to the short circuit side of the legs 2*b*' and 2*b*" of the plated through hole 2*b*. In contrast in the dielectric filter of this fourth embodiment, the plated through holes 2*a* and 2*c* have the same inner diameter at the open circuit side as that at the short circuit side. This structure provides strong inductive coupling between the first resonator defined by the inner conductor 4*a* and the second resonator defined by the inner conductor 2*b*, and further provides strong inductive coupling between the second and the third resonators.

Figure 6:
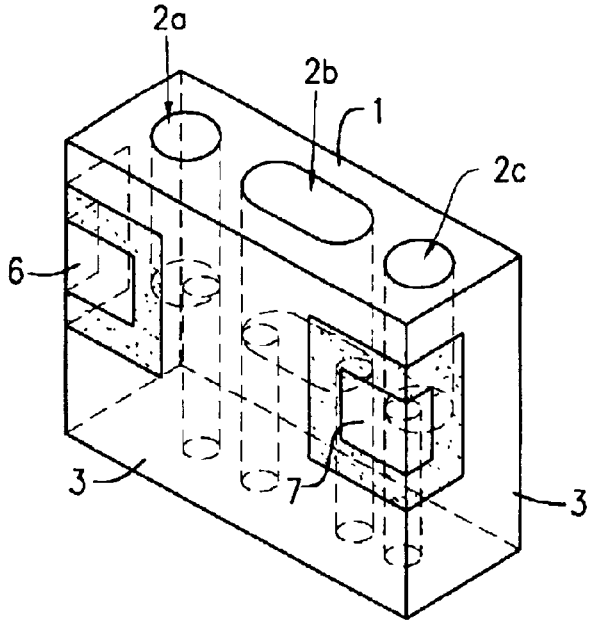
FIG. 6 is a perspective view of a dielectric filter according to a sixth embodiment of the present invention.

A sixth embodiment of the present invention is shown in FIG. 6. The dielectric filter according to the first embodiment shown in FIGS. 1A and 2B is provided with the outer conductor 3 on the six exterior surfaces of the dielectric block 1. An open circuit end of each of the resonators is defined by the inner-conductor-free areas g at one opening of each plated through hole. In the dielectric filter shown in FIG. 6, however, no outer conductor is formed on the top surface 16 of the dielectric block 1 thus providing an open circuit end surface. The outer conductor 3 is formed on the remaining five outer surfaces. The plated through hole 2*b* branches into two sections at the short circuit side so as to provide strong inductive coupling between it and the plated through holes 2*a* and 2*c*.

Figure 7:
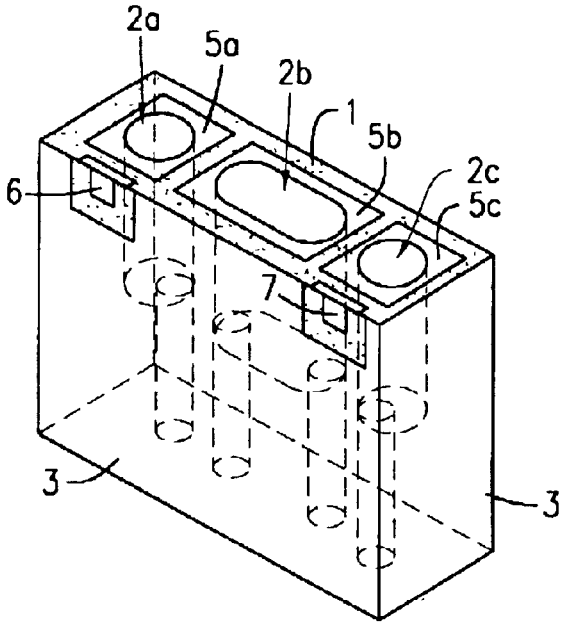
FIG. 7 is a perspective view of a dielectric filter according to a seventh embodiment of the present invention.

FIG. 7 is a perspective view of a dielectric filter according to a seventh embodiment of the present invention. The difference between the dielectric filters of the sixth and seventh embodiments is that coupling electrodes 5*a*, 5*b*, and 5*c* connected to inner conductors on the plated through holes 2*a* to 2*c* are formed on the open circuit end surface of the dielectric block 1, and that input/output electrodes 6 and 7 are also formed on the open-end surface so that a capacitance is produced between the input/output electrodes 6 and 7 and the coupling electrodes 5*a* and 5*c*. The dielectric filter according to the seventh embodiment exhibits the same advantages as those of the dielectric filters according to the first to sixth embodiments.

Figure 8A:
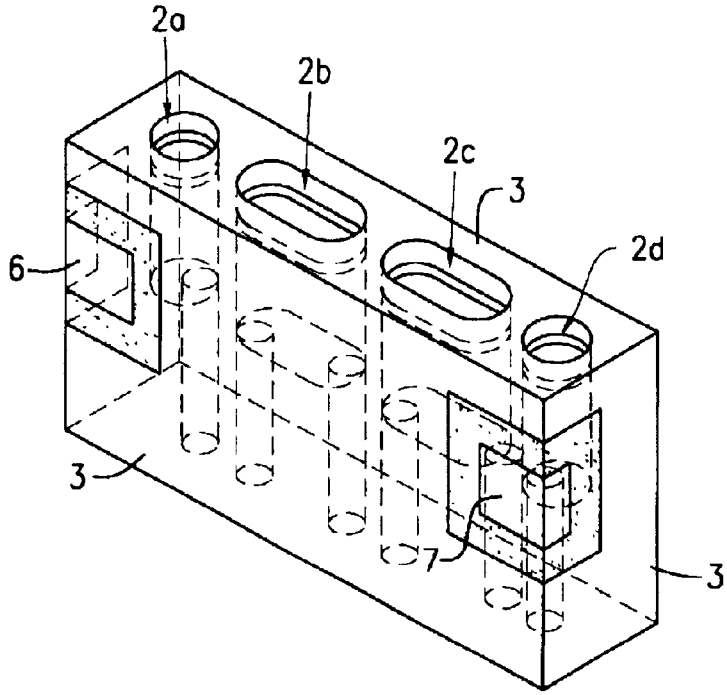
FIGS. 8A and 8B are a perspective view and a cross-sectional view of a dielectric filter according to an eighth embodiment of the present invention, respectively.
Figure 8B:
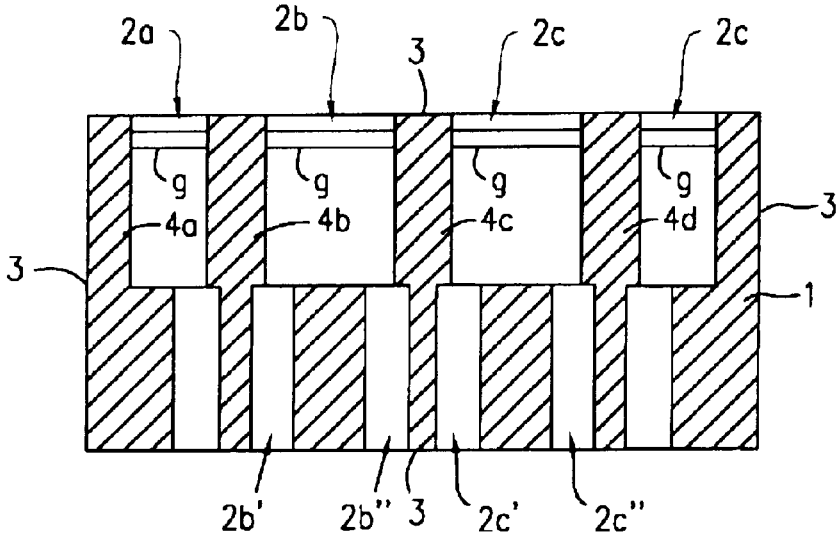

FIGS. 8A and 8B show the structure of a dielectric filter according to an eighth embodiment of the present invention. The dielectric filter according to the eighth embodiment includes four resonators formed of plated through holes 2*a* to 2*d*. Each of the plated through holes 2*b* and 2*c* branches into two sections at the short circuit side so that the axial spacing between the adjacent through holes is narrower at the short circuit side than at the open circuit side. The structure of the embodiment is otherwise the same as those of the first embodiment (FIGS. 1A and 1B). This structure provides strong inductive coupling between the first and second resonators, between the second and third resonators, and between the third and fourth resonators, thereby achieving a dielectric filter having a bandpass characteristic of a broad band.

Figure 9A:
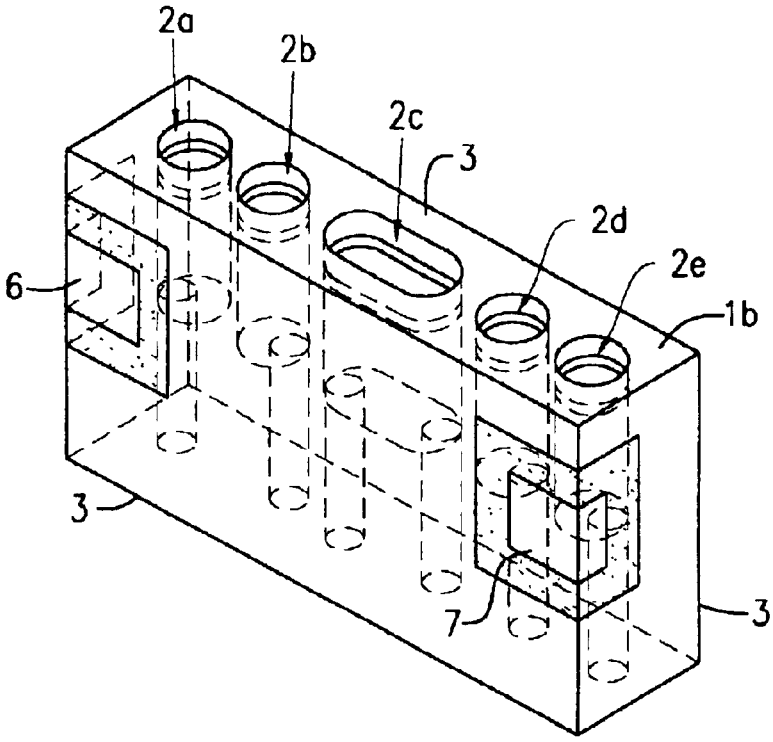
FIGS. 9A and 9B are a perspective view and a cross-sectional view of a dielectric filter according to a ninth embodiment of the present invention, respectively.
Figure 9B:
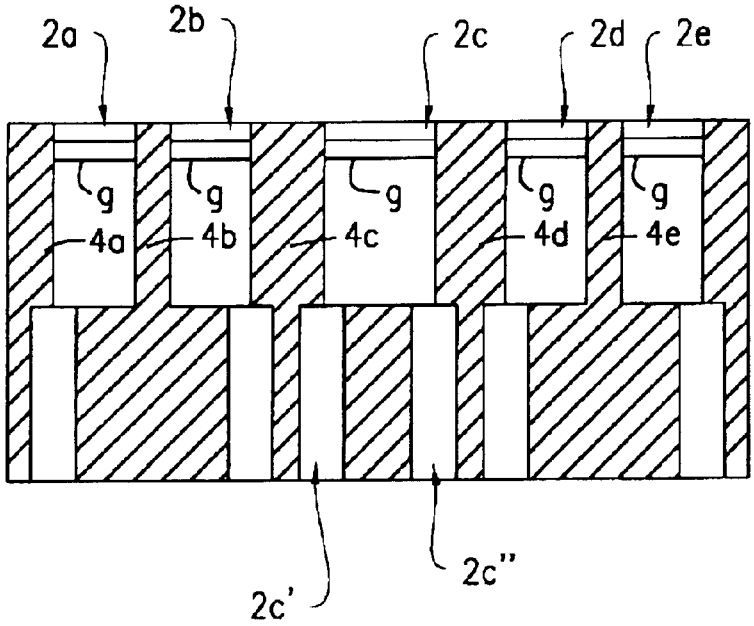

FIGS. 9A and 9B show the structure of a dielectric filter according to a ninth embodiment of the present invention which includes five resonators formed of five plated through holes 2*a* to 2*e*. An axial spacing between the resonators formed of the plated through holes 2*a* and 2*b* is relatively narrower at the open circuit side than at the short circuit side, thus providing capacitive coupling therebetween. Likewise, the resonators formed of the plated through holes 2*d* and 2*e* are capacitively coupled with each other. The plated through hole 2*c* branches into two legs 2*c*' and 2*c*" at the short circuit side. The legs 2*c*' and 2*c*" are positioned relatively close to the short circuit side of the plated through holes 2*b* and 2*d*, respectively, thereby providing inductive coupling between the second and third resonators and between the third and fourth resonator.

Figure 10:
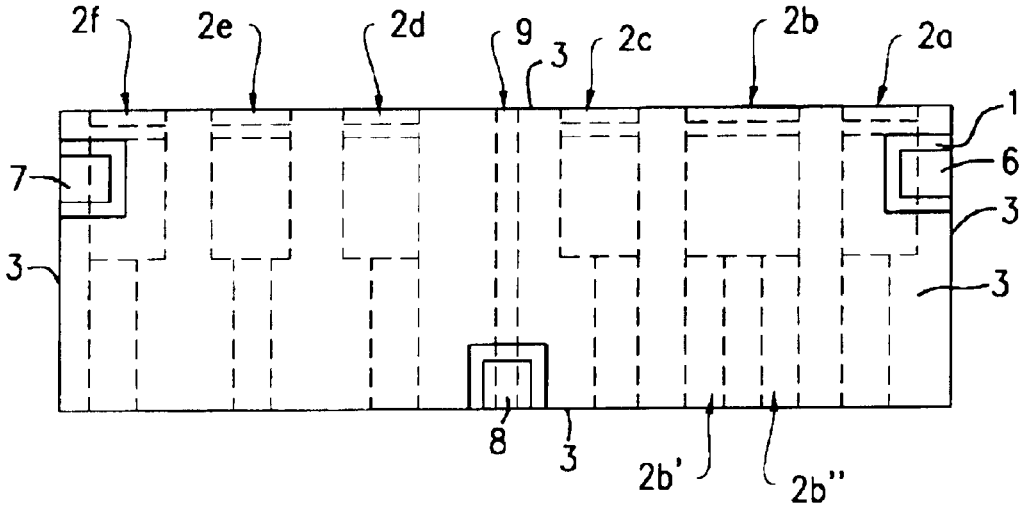
FIG. 10 is a side elevational view of a dielectric duplexer according to a tenth embodiment of the present invention.

A dielectric duplexer according to a tenth embodiment of the present invention is now described with reference to FIG. 10. A substantially rectangular dielectric block 1 includes plated through holes 2*a* to 2*f*. Each plated through hole has an inner-conductor-free area in the vicinity of one opening thereof, to define an open circuit and of the resonator defined by the inner conductor. The dielectric block 1 further includes an excitation hole 9 having an inner conductor formed thereon. An outer conductor 3 is formed on the six exterior surfaces of the dielectric block 1. Input/output electrodes 6, 7, and 8 are also formed on exterior surfaces of dielectric block 1 so as to be isolated from the outer conductor 3. The input/output electrodes 6 and 7 are capacitively coupled with the plated through holes 2*a* and 2*f*, respectively, in the vicinity of the open circuit ends of the associated inner conductors. The input/output electrode 8 is connected to the inner conductor formed on the internal surface of the excitation hole 9 so that the inner conductor on the excitation hole 9 is coupled with the resonators formed of the plated through holes 2*c* and 2*d* in an interdigital manner.

The plated through hole 2*b* is elliptical in cross section at the open circuit side adjacent to top surface 1*b* so that the elliptic shape of the plated through hole 2*b* extends toward the plated through holes 2*a* and 2*c* adjacent thereto. The plated through hole 2*b* branches into two legs 2*b*' and 2*c*' at the short circuit side. The legs 2*b*' and 2*b*" are positioned close to the short circuit side of the plated through holes 2*a* and 2*c* adjacent thereto, respectively.

The plated through holes 2*a* and 2*c* have a larger inner diameter at the open circuit side than at the short circuit side. The plated through holes 2*a* and 2*c* at the short circuit side are positioned close to the short circuit side of the legs 2*b*' and 2*b*" of the plated through hole 2*b*.

Accordingly, the axial spacing between the legs 2*b*' and 2*b*" of the plated through hole 2*b* and the plated through holes 2*a* and 2*c* adjacent thereto is relatively closer at the short circuit side than at the open circuit side, thereby providing strong inductive coupling between the first and second resonators on the one hand, and between the second and third resonators on the other.

With this structure, the three resonators formed of the plated through holes 2*a* to 2*c* form a transmission filter, and the three resonators formed of the plated through holes 2*d* to 2*f* form a reception filter. The three resonators formed of the plated through holes 2*a* to 2*c* provides inductive coupling between the first and second resonators, and between the second and third resonators, as described above, thereby producing an attenuation pole at a high-frequency region of the transmission filter. In the three resonators formed of the plated through holes 2*d* to 2*f*, the axial spacing between the adjacent plated through holes at the open circuit side is relatively narrower than at the short circuit side to provide capacitive coupling therebetween, thereby producing an attenuation pole at a low-frequency region of the reception filter. These attenuation poles ensure a significant amount of attenuation at the boundary of the transmission band and the reception band.

Figure 11:
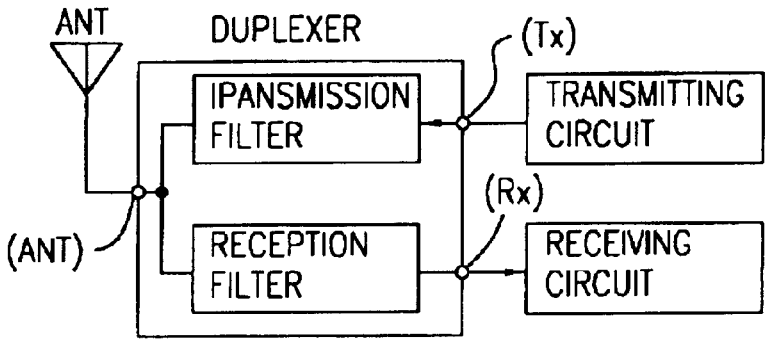
FIG. 11 is a block diagram of a communication apparatus according to the present invention.
Figure 12A:
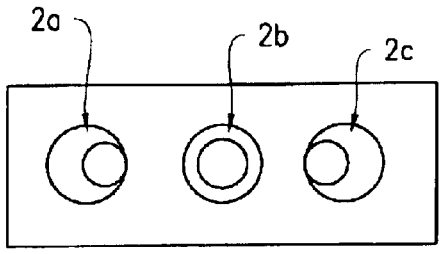
(PRIOR ART) FIG. 12A
FIGS. 12A and 12B are a top plan view and a cross-sectional view of a dielectric filter in the prior art, respectively.
Figure 12B:
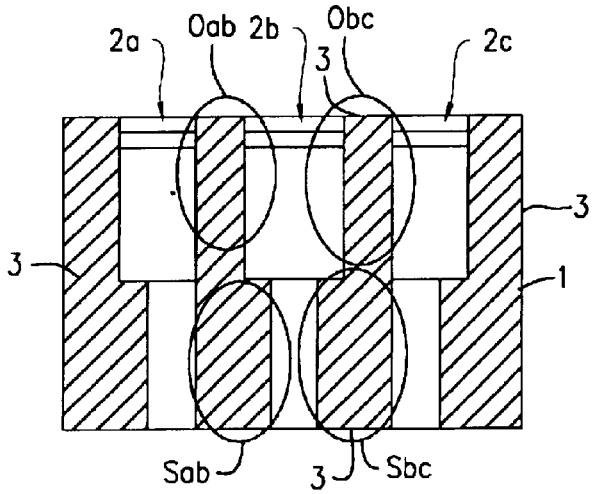
(PRIOR ART) FIG. 12B
Figure 13:
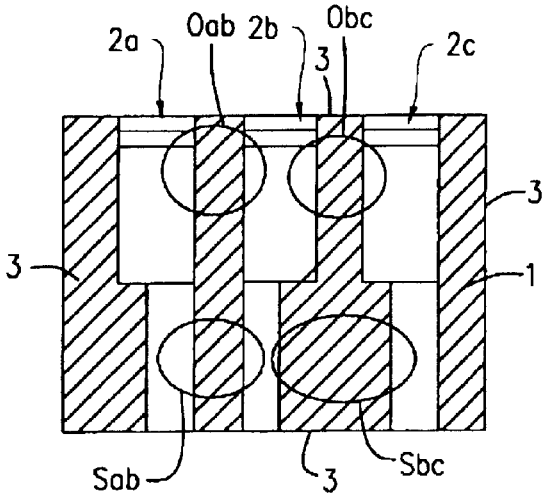
(PRIOR ART) FIG. 13
FIG. 13 is a cross-sectional view of a dielectric filter in the prior art.

FIG. 11 shows the structure of a communication apparatus according to an eleventh embodiment of the present invention. In FIG. 11, a duplexer is formed of a transmission filter and a reception filter, and may be the dielectric duplexer shown in FIG. 10. The duplexer has a transmission-signal input port (Tx) connected to a transmitting circuit, a received-signal output port (Rx) connected to a receiving circuit, and an antenna port (ANT) connected to an antenna. The output unit of the transmitting circuit and the input unit of the receiving circuit are each provided with a band-pass filter, and the band-pass filter may comprise a dielectric filter having any of the structures shown in FIGS. 1A to 9B.

According to the present invention, therefore, a communication apparatus using a compact dielectric filter or dielectric duplexer having a predetermined characteristic can be compact and lightweight.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A dielectric filter comprising:

a dielectric block having first and second opposed surfaces;

an outer conductor formed on exterior surfaces of said dielectric block;

a plurality of through holes extending from the first to the second surface of the dielectric block;

a respective inner conductor formed on each of the through holes to form respective plated through holes, each inner conductor having a short circuit end directly coupled to the outer conductor and an open circuit end capacitively coupled to the outer conductor; and at least one of the plated through holes branching into a plurality of legs, each of the plurality of legs having a short circuit end directly coupled to the outer conductor.

2. A dielectric duplexer comprising a transmission filter and a reception filter, each filter comprising the dielectric filter according to claim 1.

3. A communication apparatus comprising the dielectric filter according to claim 1.

4. A dielectric filter, comprising:

a dielectric block having first and second opposed surfaces;

an outer conductor formed on exterior surfaces of said dielectric block;

a plurality of through holes extending from the first to the second surface of the dielectric block;

a respective inner conductor formed on each of the through holes to form respective plated through holes, each inner conductor having a short circuit end directly coupled to the outer conductor and an open circuit end capacitively coupled to the outer conductor; and at least one of the plated through holes branching into a plurality of legs, each of the plurality of legs having a short circuit end directly coupled to the outer conductor, wherein a branching position of the plurality of legs is substantially at the center of the plated through holes in a longitudinal direction thereof.

5. A dielectric filter comprising:

a dielectric block having first and second opposed surfaces;

an outer conductor formed on exterior surfaces of said dielectric block;

a plurality of through holes extending from the first to the second surface of the dielectric block;

a respective inner conductor formed on each of the through holes to form respective plated through holes each inner conductor having a short circuit end directly coupled to the outer conductor and an open circuit end capacitively coupled to the outer conductor; and at least one of the plated through holes branching into a plurality of legs, each of the plurality of legs having a short circuit end directly coupled to the outer conductor, wherein at least one of the plurality of legs has an inner diameter which is different than that of the other legs.

* * * * *